United States Patent [19]

Steiner

[11] 3,969,037

[45] July 13, 1976

[54] TURBULATORS

[75] Inventor: Peter Steiner, Edison, N.J.

[73] Assignee: Foster Wheeler Energy Corporation, Livingston, N.J.

[22] Filed: May 7, 1975

[21] Appl. No.: 575,327

Related U.S. Application Data

[62] Division of Ser. No. 490,432, July 18, 1974.

[52] U.S. Cl. ..... 416/176; 416/212 R

[51] Int. Cl.[2] ..... B01F 7/08

[58] Field of Search ..... 416/176, 177, 212, 213; 29/157 R, 157.3 AH, 157.3 D, 456, 463, 505, DIG. 3; 259/4, DIG. 30; 138/42; 48/180 M

[56] References Cited

UNITED STATES PATENTS

| | | | |
|---|---|---|---|
| 102,645 | 5/1870 | Arlan et al. | 416/176 |
| 371,609 | 10/1887 | Marr | 416/177 |
| 1,710,042 | 4/1929 | Bundy | 29/456 |
| 1,758,062 | 5/1930 | Replogle | 416/213 A |
| 3,128,536 | 4/1964 | Eckhardt | 416/176 X |
| 3,328,868 | 7/1967 | Eckhardt | 29/157.3 AH |

FOREIGN PATENTS OR APPLICATIONS

| | | | |
|---|---|---|---|
| 527,835 | 7/1956 | Canada | 416/176 |
| 62,821 | 12/1913 | Austria | 416/176 |

*Primary Examiner*—Everette A. Powell, Jr.
*Attorney, Agent, or Firm*—John E. Wilson; Marvin A. Naigur

[57] ABSTRACT

A multivane turbulator has been provided wherein at least two "V"-shaped members forming the vanes thereof are disposed with their vertices adjacent one another and twisted about each other such that the pitch of the twist is sufficient to render the turbulator self-supporting with symmetrically disposed vanes about a central axis.

The method of forming the turbulators includes the steps of bending at least two strips of flat stock into "V"-shaped members and disposing one adjacent the other at their vertices and twisting same until the vanes are self-supporting.

6 Claims, 5 Drawing Figures

TURBULATORS

This is a division of application Ser. No. 490,432, filed July 18, 1974.

BACKGROUND OF INVENTION

In certain chemical processes it is necessary to conduct fluid in both gaseous and liquid form through tubes during different stages of the specific process. In certain instances it is necessary to impart turbulence to the fluid in order to enhance the mixing quality to the flow and as such it is necessary to insert in the tubes or conduits means for creating turbulence. One such device is a multivane turbulator, which is a member which fits within the tube or conduit and resembles a spiral such that the liquids or fluids will flow about the vanes of the spiral thus creating the required turbulence.

The manufacture of these devices has been quite complicated and expensive in the past because of the special apparatus necessary to produce the device. For example, certain methods require the joining of strips of flat stock at a central point welding the stock together and twisting the stock in order to produce the turbulator. Other methods include wrapping a flat member about a central axis support member and welding the member at different points along the support member. Both of the aforementioned methods require comparatively high production costs and time, which the present invention has as one of its purposes to reduce.

When it is necessary to produce turbulators with a large number of vanes, for example, six or eight, the aforementioned processes become even more difficult and expensive to accomplish since the materials become cumbersome in handling. The present system of producing multivane turbulators, therefore, is designed to permit production of turbulators having different numbers of vanes as required for a particular process.

It is, therefore, an object of the present invention to provide a method for producing multivane turbulators which are simple and require relatively inexpensive production apparatus and materials.

It is another object of the present invention to produce multivane turbulators which are self-supporting and require little or no welding to produce.

It is another object of the present invention to provide a simplified method for producing multivane turbulators in order to reduce production costs and time.

SUMMARY OF INVENTION

A multivane turbulator has been provided wherein at least two V-shaped members forming the vanes thereof are disposed with their vertices adjacent one another and twisted about each other such that the pitch of the twist is sufficient to render the turbulator self-supporting with symmetrically disposed vanes about a central axis.

The method of forming the turbulators includes the steps of bending at least two strips of flat stock into V-shaped members and disposing one adjacent to the other at their vertices and thereafter twisting the same to thereby render the vanes self-supporting.

For a better understanding of the present invention, reference is directed to the following description taken in connection with the accompanying drawings while its scope will be pointed out in the appended claims.

DESCRIPTION OF THE PREFERRED EMBODIMENTS

Figure 1:
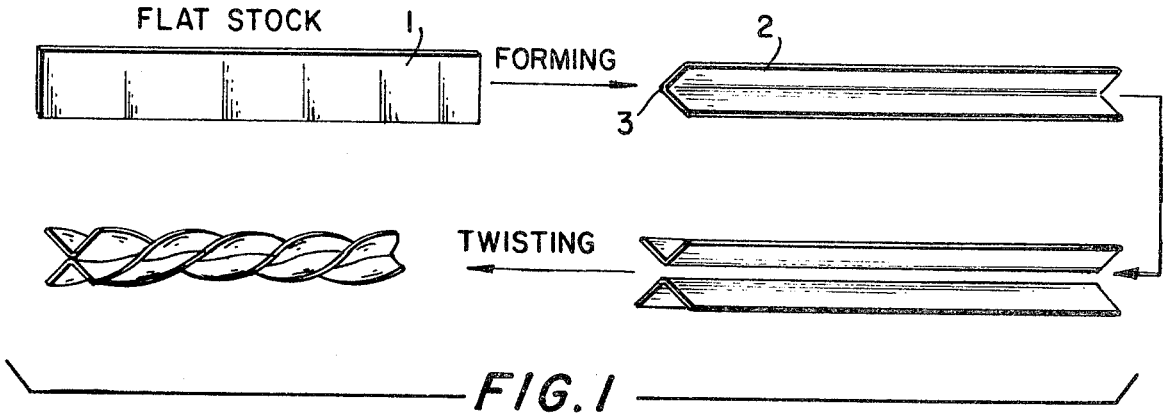
FIG. 1 shows diagramatically the steps involved in forming the turbulator of the present invention.

FIG. 1 shows the steps for producing the apparatus for the present invention. These steps include forming from segments of flat stock 1, V-shaped members 2, thereafter laying out the V-shaped members with their vertices 3 adjacent one another and thereafter imparting a twist to the members so that the turbulator 5 is formed. The method described above requires no welding generally if the V-shaped members 2 are twisted to a pitch of about 180° for an equivalent of a distance of about two diameters D of the turbulator. The proportions thereof are shown in element 5 of FIG. 1.

Figure 2:
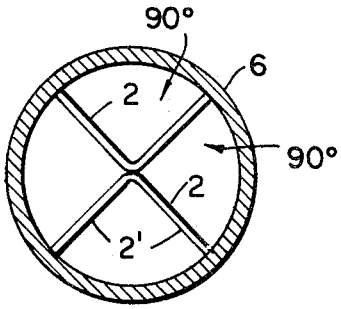
FIG. 2 shows in crossection a turbulator of the present invention inserted in a tube.

Turbulator 5 formed as a result of the process illustrated in FIG. 1 is shown in cross section in FIG. 2 in a tube member 6. The turbulator shown is a four-vane turbulator with the bend formed in the V-shaped member 2 at approximately 90°.

Figure 3:
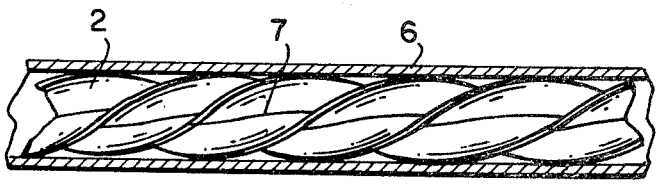
FIG. 3 shows the turbulator of FIG. 2 in a fragmented side elevation.

In FIG. 3 the same turbulator 5 is shown lengthwise disposed in the tube 6 the axis 7 of which appears through alternating seam sections 8 of the device. Since the turbulator vanes 2 are twisted about each other, the seam 8 conforms to the axis 7 of the turbulator and therefore no support member is necessary. If the pitch is sufficient, the turbulator will need no welding to keep the members 2 aligned laterally. The advantages of such a system and method are clear, since the vanes of the turbulator are rigid and the method is extremely simple to implement.

The turbulator 5 may be formed with one end fixed in a vise or the like and the other is secured in a head which may be rotated relative to the fixed end. Alternately the devise may be twisted at both ends in a controlled fashion or any convenient way so that the pitch of the turbulator is controlled to form a self-supporting member.

It should be understood that the method of the present invention may form a turbulator of varying pitch. If a slight pitch were required, however, there might be slippage of one member 2 relative to the other and tack welding would be necessary in order to keep the turbulator vanes fixed relative one to the other.

Figure 4:
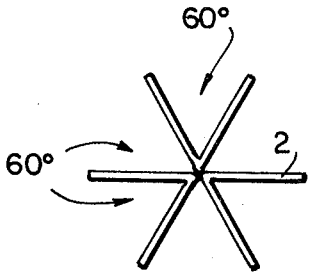
FIGS. 4 and 5 show alternate embodiments of the present invention with different numbers of turbulator vanes.
Figure 5:
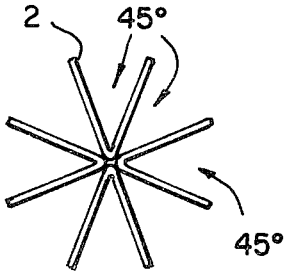

In FIGS. 4 and 5 alternate embodiments of the present invention are shown wherein six and eight vane turbulators are illustrated respectively. The V-shaped members 2 in FIGS. 4 and 5 have approximately 60° and 45° bends respectively, so as to be evenly disposed radially in 360°. The radial portions of the V-shaped members 2 may be disposed unevenly if required for a particular application.

There are limits to the number of vanes which can be formed which corresponds to the thickness of the stock 1 utilized in the forming of the V-shaped members 2. As a practical matter, in the processes contemplated, eight vaned turbulators (FIG. 5) will probably be all that will be required. It is, of course, possible to form turbulators with numbers of vanes exceeding eight as shown in FIG. 5. The embodiments of FIGS. 4 and 5 as well as that of FIG. 2 are shown in order to illustrate the manner in which the number of vanes may be multiplied for particular requirements. A ten vane turbulator could be produced by twisting five V-shaped members having an angle bend of 36° for a regular radial configuration.

The advantages of the present invention permit the simple and inexpensive fabrication of turbulator vanes on a production basis. It is no longer necessary to weld the members together except for very short devices or those with a relatively small pitch. Bending the vanes about a central axis or core requiring expensive apparatus and skilled workmen is no longer necessary.

While other pitch configurations are possible, a pitch of about 180° for about 2 diameters D of the turbulator is convenient for certain processes and renders the turbulator self-supporting. However, if a looser pitch proved desirable, a longer length of turbulator-V-shaped member could be used for a self-supporting device.

While there have been described what at present are considered to be the preferred embodiments of the present invention, it should be understood that certain modifications and changes may be made therein without departing from the spirit of the invention, and is therefore intended in the appended claims to cover all such modifications and changes as fall within the true spirit and scope of the invention.

What is claimed is:

1. A multi-vane turbulator comprising;

a plurality of relatively elongated members, each of said members being V-shaped in cross section with two straight segments integral with and joined to each other at a bend in said member and with each of said cross sectional straight segments lying on a spiral vane encircling the longitudinal axis of said turbulator, each of said bends being in contact with the other of said bends substantially along the length of said turbulator.

2. The apparatus of claim 1 wherein three V-shaped members are utilized and wherein the members are bent so that each of said vanes at any cross sectional plane are at an angle of approximately 60° with its adjacent vanes.

3. The apparatus of claim 1 wherein four V-shaped members are utilized and wherein each of said vanes is at an angle of approximately 45° to each of the adjacent vanes.

4. The apparatus of claim 1 wherein the pitch is approximately 180° for a distance of approximately two diameters of the turbulator.

5. The apparatus of claim 1 wherein the vanes are generally symmetrically disposed about the central axis of the turbulator.

6. The apparatus of claim 1 wherein the bend in each of the V-shaped members is approximately 90° and the cross section of the turbulator resembles an "X".

* * * * *